US012774540B2

(12) United States Patent
Pourdeyhimi

(10) Patent No.: US 12,774,540 B2
(45) Date of Patent: Oct. 27, 2026

(54) METHOD TO INCLUDE LIQUID ADDITIVES INTO POLYMER DURING THE PRODUCTION OF FIBERS

(71) Applicant: North Carolina State University, Raleigh, NC (US)

(72) Inventor: Behnam Pourdeyhimi, Raleigh, NC (US)

(73) Assignee: North Carolina State University, Raleigh, NC (US)

( * ) Notice: Subject to any disclaimer, the term of this patent is extended or adjusted under 35 U.S.C. 154(b) by 636 days.

(21) Appl. No.: 17/147,600

(22) Filed: Jan. 13, 2021

(65) Prior Publication Data

US 2021/0214859 A1 Jul. 15, 2021

Related U.S. Application Data

(60) Provisional application No. 62/961,260, filed on Jan. 15, 2020.

(51) Int. Cl.

| | |
|---|---|
| ***D01F 1/10*** | (2006.01) |
| ***D01D 1/02*** | (2006.01) |
| ***D01D 1/04*** | (2006.01) |
| ***D01D 5/08*** | (2006.01) |
| ***D01F 8/06*** | (2006.01) |
| ***D04H 1/4291*** | (2012.01) |
| ***D04H 1/4382*** | (2012.01) |

(52) U.S. Cl.

CPC ..... *D01F 1/103* (2013.01); *D01D 1/02* (2013.01); *D01D 1/04* (2013.01); *D01D 5/08* (2013.01); *D01F 8/06* (2013.01); *D04H 1/4291* (2013.01); *D04H 1/43828* (2020.05); *D04H 1/43832* (2020.05)

(58) Field of Classification Search

CPC ... D01D 1/02; D01D 1/04; D01D 5/08; D01F 1/103; D01F 8/06; D01F 1/10; D01F 6/04; D04H 1/4291; D04H 1/43828; D04H 1/43832; D04H 3/007; D04H 3/147; D04H 3/16; A61L 2430/32; A61L 27/18; A61L 27/26; A61L 27/58; C08L 67/04

See application file for complete search history.

(56) References Cited

U.S. PATENT DOCUMENTS

2010/0291384 A1* 11/2010 Gabriele ..... D01D 5/30 428/375

FOREIGN PATENT DOCUMENTS

EP 1718700 A1 * 11/2006 ..... A61L 2/08

* cited by examiner

*Primary Examiner* — Lynda Salvatore
(74) *Attorney, Agent, or Firm* — NK Patent Law

(57) ABSTRACT

Method of producing fibers comprises forming a blend of a liquid additive and a poly-alpha-olefin (PAO) fluid. The method also includes adding the blend to a polymer to form a composition. The method further includes melting the composition within an extruder. The method furthermore includes spinning fiber, through the extruder, from the composition.

20 Claims, 8 Drawing Sheets

| Weight loss % vs time of exposure to 50 °C | | | | | |
|---|---|---|---|---|---|
| NW | 5 days | 12 days | 19 days | 26 days | 30 days |
| Top note | 0.44 | 0.88 | 0.88 | 1.33 | 1.33 |
| Concentrated | 0.5 | 0.5 | 1 | 1.5 | 0.5 |
| Bottom note | 0 | 0 | 0.45 | 0.45 | 0.45 |
| Bounce | 0.95 | 1.4 | 2.3 | 2.85 | 3.3 |
| Suavitel | 0.99 | 1.9 | 2.4 | 3.4 | 3.9 |
| Gain | 0.94 | 1.4 | 1.88 | 2.23 | 3.3 |
| Cedar Citronella | 0.46 | 0.93 | 0.93 | 1.39 | 1.39 |

FIG. 4A

Addition of fragrance/oil blend to PP homopolymer filaments

| Sample | Description | Filament denier | Tenacity | Maximum force | Maximum Elongation | Force @ 10% elongation |
|---|---|---|---|---|---|---|
| | | (g/9000 l.m.) | (g/denier) | g | % | g |
| 1 | PP Control no oil added | 3.0 | 4.2 | 12.5 | 121 | 5.6 |
| 2 | PP Control no oil added | 3.0 | 3.9 | 11.8 | 133 | 4.6 |
| 3 | PP Control + 3% oil added | 3.0 | 4.0 | 11.8 | 135 | 4.8 |
| 4 | PP + Blend 1 at 4% add-on | 3.0 | 3.4 | 10.0 | 158 | 3.7 |
| 5 | PP + Blend 1 at 3% add-on | 2.9 | 4.2 | 12.3 | 140 | 4.5 |
| 6 | PP + Blend 2 at 3% add-on | 3.0 | 4.1 | 12.2 | 144 | 4.9 |
| 7 | PP + Blend 3 at 3% add-on | 3.0 | 4.0 | 12.0 | 115 | 5.1 |
| 8 | PP + Blend 4 at 4% add-on | 3.0 | 3.5 | 10.6 | 186 | 3.35 |
| 9 | PP + Blend 4 at 3% add-on | 2.9 | 4.0 | 11.6 | 115 | 5 |

FIG. 5

Addition of fragrance/oil mixture to the core of PP/PP S/C bicomponent filaments

| Sample | Description | Filament denier | Tenacity | maximum force | maximum Elongation | Force @ 10% elongation |
|---|---|---|---|---|---|---|
| | | (g/9000 l.m.) | (g/denier) | (g) | % | g |
| 10 | PP/PP Bicomponent S/C 30/70 with no additive (Baseline) | 3 | 4.1 | 12.4 | 144 | 4.5 |
| 11 | PP/PP Bicomponent S/C 30/70 with Blend 1 @ 4% in the core | 3 | 4 | 11.9 | 143 | 4.2 |
| 12 | PP/PP Bicomponent S/C 30/70 with Blend 1 @ 6% in the core | 3 | 3.7 | 11.2 | 158 | 3.6 |
| 13 | PP/PP Bicomponent S/C 30/70 with Blend 1 @ 8% in the core | 3 | 3.6 | 10.8 | 150 | 3.8 |
| 14 | PP/PP Bicomponent S/C 30/70 with Blend 4 @ 4% in the core | 3 | 3.4 | 10.1 | 141 | 3.4 |

FIG. 6

Addition of fragrance/oil mixture to the sheath of PP/PP S/C bicomponent filaments

| Sample | Description | Filament denier | Tenacity | maximum force | maximum Elongation | Force @ 10% elongation |
|---|---|---|---|---|---|---|
| | | (g/9000 l.m.) | (g/denier) | (g) | % | g |
| 15 | PP/PP Bicomponent S/C 50/50 no additive (Baseline) | 3 | 4.1 | 12.3 | 150 | 4.5 |
| 16 | PP/PP Bicomponent S/C 50/50 no additive (Baseline repeat) | 3 | 4 | 12 | 149 | 4.7 |
| 17 | PP/PP Bicomponent S/C 50/50 with Blend 1 @ ~5.6% in the sheath | 3 | 3.9 | 11.6 | 146 | 4.4 |
| 18 | PP/PP Bicomponent S/C 50/50 with Blend 4 @ ~5.6% in thsheath | 3 | 3.9 | 11.6 | 127 | 4.9 |

FIG. 7

Addition of fragrance/oil mixture to the core of PE/PP S/C bicomponent filaments

| Sample | Description | Filament denier | Tenacity | maximum force | maximum Elongation | Force @ 10% elongation |
|---|---|---|---|---|---|---|
| | | (g/9000 l.m.) | (g/denier) | (g) | % | g |
| 19 | PE/PP Bicomponent S/C 30/70 with no additive (Baseline) | 3 | 3.1 | 9.3 | 226 | 2.5 |
| 20 | PE/PP Bicomponent S/C 30/70 with Blend 1 @ 4% in the core | 3 | 2.75 | 8.3 | 250 | 1.8 |
| 21 | PE/PP Bicomponent S/C 30/70 with Blend 1 @ 6% in the core | 3 | 2.6 | 7.8 | 232 | 1.8 |
| 22 | PE/PP Bicomponent S/C 30/70 with Blend 4 @ 4% in the core | 3 | 2.8 | 8.5 | 253 | 1.9 |

FIG. 8

METHOD TO INCLUDE LIQUID ADDITIVES INTO POLYMER DURING THE PRODUCTION OF FIBERS

CROSS-REFERENCE TO RELATED APPLICATIONS

This application claims the benefit of U.S. Provisional Patent Application No. 62/961,260, filed on Jan. 15, 2020, the entire content of which is incorporated herein by reference.

TECHNICAL FIELD

The present invention relates generally to the field of fiber fabrication, and particularly, to a system and method of mixing additives into a polymer during the production of fibers.

BACKGROUND

It is common practice to mix solid additives with polymers during the process of making fibers by the melt spinning process. Mixing solid additives with polymers during fiber-making is accomplished in an extruder during the melt spinning process. A solid additive is introduced into a polymer formulation by the use of a masterbatch that is dry blended with a virgin polymer or a mixture of polymers prior to extrusion. The masterbatch is created by mixing the additive with a molten polymer, with this process typically performed in an extruder and the mixture is expelled through a spinneret forming strands that are cut into pellets. The concentration of the additive in the masterbatch can vary from less than 1% of the masterbatch to 80% or more of the masterbatch. For example, additive calcium carbonate accounts for 70-80% of the content by weight in a masterbatch containing calcium carbonate and polypropylene. Whereas the method of mixing the additive with a molten polymer is typically used for solid additives, this method is restricted to solid additives as there are several difficulties associated with adding a volatile liquid to a polymer during extraction. This is due to one of two reasons: (1) the liquid is not viscous enough to form a film around pellets prior to melting, or (2) the liquid is too volatile and escapes through the extruder throat.

Accordingly, there is a need for a technique that allows for introducing liquid additives during the production of polymeric fibers, particularly those liquid additives that are not suitable for compounding into a masterbatch; there is further a need for a technique that allows for the slow release of the additives from the polymeric fibers while the article made from them is being used.

SUMMARY

This summary is provided to introduce in a simplified form concepts that are further described in the following detailed descriptions. This summary is not intended to identify key features or essential features of the claimed subject matter, nor is it to be construed as limiting the scope of the claimed subject matter.

In accordance with the purposes of the disclosed devices and methods, as embodied and broadly described herein, the disclosed subject matter relates to devices and methods of use thereof. Additional advantages of the disclosed devices and methods will be set forth in part in the description, which follows, and in part will be obvious from the description. The advantages of the disclosed devices and methods will be realized and attained by means of the elements and combinations particularly pointed out in the appended claims. It is to be understood that both the foregoing general description and the following detailed description are exemplary and explanatory only and are not restrictive of the disclosed compositions, as claimed.

The details of one or more embodiments of the invention are set forth in the accompanying drawings and the description below. Other features, objects, and advantages of the invention will be apparent from the description and drawings, and from the claims.

Disclosed herein is a method of producing fibers. In various embodiments, the method comprises: forming a blend of a liquid additive and a poly-alpha-olefin (PAO) fluid; providing a polymer; adding the blend to the polymer followed by melting the polymer in an extruder to form a molten composition, or melting the polymer in the extruder followed by adding the blend to the melted polymer to form a molten composition; and spinning fibers from the molten composition.

According to at least one embodiment, the liquid additive comprises a fragrance

According to at least one embodiment, the method further comprises fabricating one or more of a continuous filament fiber and a staple fiber from the composition.

According to at least one embodiment, the polymer comprises a polyolefin

According to at least one embodiment, the polymer comprises an olefin segment.

According to at least one embodiment, the method further comprises fabricating a nonwoven web from the composition.

According to at least one embodiment, the nonwoven web comprises one or more of: a spunbond nonwoven web, a hydro-entangled nonwoven web, and a meltblown nonwoven web.

According to at least one embodiment, the nonwoven web is a composite comprising one or more of: a spunbond nonwoven web, a hydro-entangled nonwoven web, a meltblown nonwoven web.

According to at least one embodiment, the fiber comprises one or more of: a mono-component fiber, a bi-component fiber, and a multi-component fiber.

According to at least one embodiment, the fiber comprises a multi-component fiber, wherein the multi-component fiber comprises one of a: sheath and core (S/C) cross-section, side-by-side (S/S) cross-section, segmented pie cross-section, segmented ribbon cross-section, tipped trilobal cross-section, and island in sea (INS) cross-section.

According to at least one embodiment, the method further comprises forming a multi-component fiber comprising a domain and a plurality of components, wherein the liquid additive is added to the domain, wherein the liquid additive is not added to the plurality of components.

According to at least one embodiment, the method further comprises forming a multi-component fiber comprising a plurality of domains and a plurality of components, wherein the liquid additive is added to domains exposed at an outer surface of the multi-component fiber, wherein the liquid additive is not added to the plurality of components.

According to at least one embodiment, the fiber comprises a meltspun fiber.

According to at least one embodiment, the meltspun fiber comprises a multi-component fiber comprising a domain and a plurality of components, wherein a concentration of the liquid additive is higher in the domain as compared to the concentration of the liquid additive in each of the plurality of components.

According to at least one embodiment, the meltspun fiber comprises a multi-component fiber comprising a plurality of domains and a plurality of components, wherein a concentration of the liquid additive is higher in the domains exposed at an outer surface of the multi-component fiber as compared to the concentration of the liquid additive in each of the plurality of components.

According to at least one embodiment, the fiber comprises a nonwoven meltspun fiber, wherein the nonwoven meltspun fiber comprises a multi-component fiber comprising a domain and a plurality of components, a concentration of the liquid additive is higher in the domain as compared to the concentration of the liquid additive in each of the plurality of components.

According to at least one embodiment, the fiber comprises a nonwoven meltspun fiber, wherein the nonwoven meltspun fiber comprises a multi-component fiber comprising a plurality of domains and a plurality of components, wherein a concentration of the liquid additive is higher in domains exposed at an outer surface of the multi-component fiber as compared to a remainder of the plurality of domains and as compared to the each of the plurality of components.

According to at least one embodiment, the fiber comprises a nonwoven meltspun fiber, wherein the nonwoven meltspun fiber comprises one or more of: a spunbond nonwoven meltspun fiber, a hydro-entangled nonwoven meltspun fiber, and a meltblown nonwoven meltspun fiber.

According to at least one embodiment, the nonwoven meltspun fiber comprises a multi-component fiber comprising a domain and a plurality of components, wherein a concentration of the liquid additive is higher in the domain as compared to the plurality of components, wherein the nonwoven meltspun fiber comprises one or more of: a spunbond nonwoven meltspun fiber, a hydro-entangled nonwoven meltspun fiber, and a meltblown nonwoven meltspun fiber.

According to at least one embodiment, the nonwoven meltspun fiber comprises a multi-component fiber comprising a plurality of domains and a plurality of components, wherein a concentration of the liquid additive is higher in domains exposed at an outer surface of the multi-component fiber as compared to a remainder of the plurality of domains and as compared to the each of the plurality of components, wherein the nonwoven meltspun fiber comprises one or more of: a spunbond nonwoven meltspun fiber, a hydro-entangled nonwoven meltspun fiber, and a meltblown nonwoven meltspun fiber.

According to at least one embodiment, adding the blend comprises one or more of injecting and pumping the blend through a port drilled into an extruder barrel of the extruder.

BRIEF DESCRIPTION OF THE DRAWINGS

The foregoing, as well as the following Detailed Description of preferred embodiments, is better understood when read in conjunction with the appended drawings. For the purposes of illustration, there is shown in the drawings exemplary embodiments; however, the presently disclosed subject matter is not limited to the specific methods and instrumentalities disclosed.

The embodiments illustrated, described, and discussed herein are illustrative of the present invention. As these embodiments of the present invention are described with reference to illustrations, various modifications, or adaptations of the methods and or specific structures described may become apparent to those skilled in the art. It will be appreciated that modifications and variations are covered by the above teachings and within the scope of the appended claims without departing from the spirit and intended scope thereof. All such modifications, adaptations, or variations that rely upon the teachings of the present invention, and through which these teachings have advanced the art, are considered to be within the spirit and scope of the present invention. Hence, these descriptions and drawings should not be considered in a limiting sense, as it is understood that the present invention is in no way limited to only the embodiments illustrated.

FIG. 4A illustrates results from a weight loss percentage (WL %) test conducted on fibers fabricated using the methods described herein over various time intervals.

FIGS. 5-8 illustrates a table that summarizes the results of the testing of physical properties of 22 samples of the filaments formed by process disclosed herein, according to one or more embodiments of the presently disclosed subject matter.

DETAILED DESCRIPTION

Figure 1:
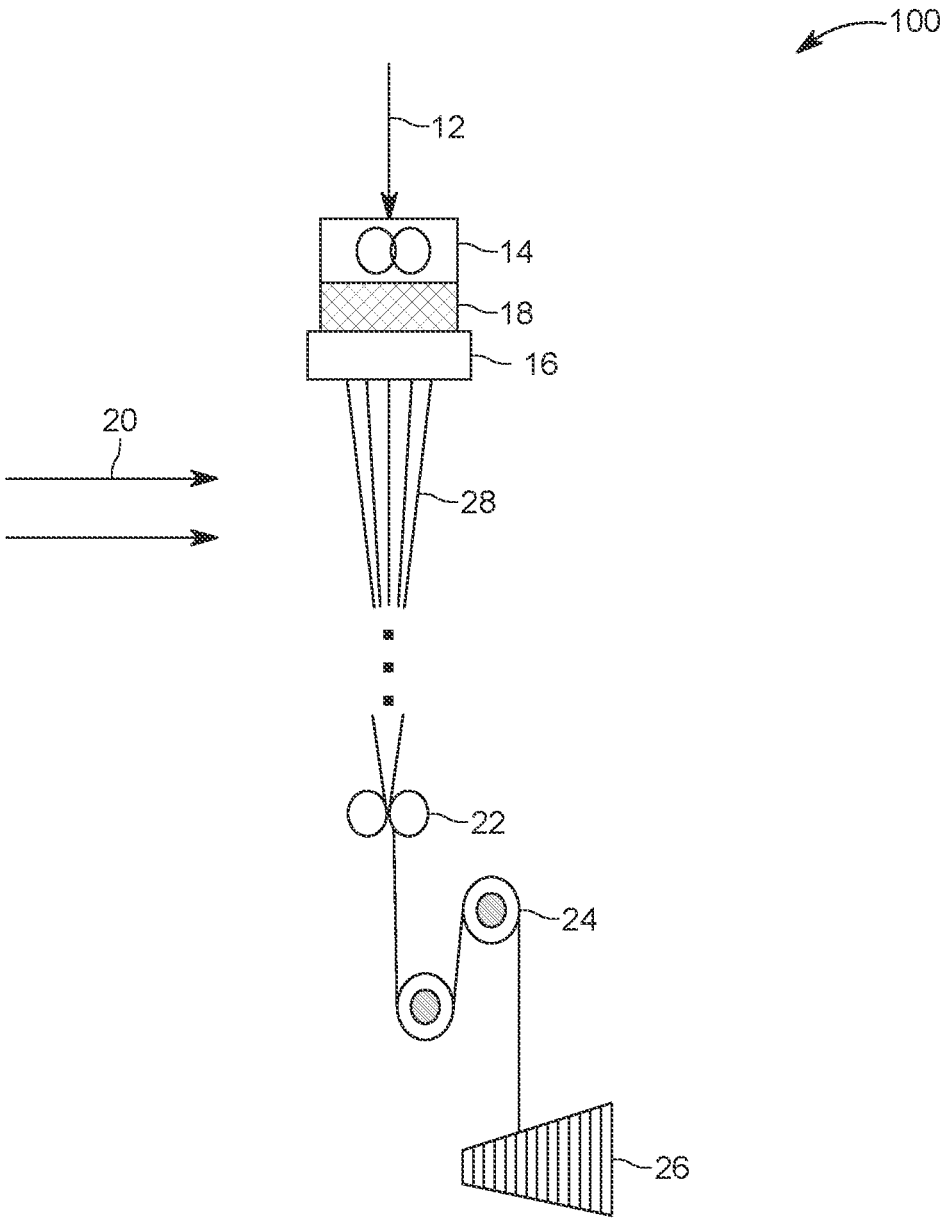
FIG. 1 illustrates a schematic view of an extruder used for a melt spinning process, according to one or more embodiments of the presently disclosed subject matter.

The following description and drawings are illustrative and are not to be construed as limiting. Numerous specific details are described to provide a thorough understanding of the disclosure. However, in certain instances, well-known or conventional details are not described in order to avoid obscuring the description. References to "one embodiment" or "an embodiment" in the present disclosure can be, but not necessarily are, references to the same embodiment and such references mean at least one of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way.

Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only, and is not intended to further limit the scope and meaning of the disclosure or of any exemplified term. Likewise, the disclosure is not limited to various embodiments given in this specification.

Without intent to limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

Mixing additives with polymers during fiber-making is accomplished in an extruder during the melt spinning process. The typical procedure for introducing an additive into a polymer formulation is with a masterbatch, which combines an additive with a molten polymer. This method, however, is restricted to solid additives as there several difficulties associated with adding a volatile liquid to a polymer during extraction. This is due to one of two reasons: (1) the liquid is not viscous enough to form a film around pellets prior to melting, or (2) the liquid is too volatile and escapes through the extruder throat. Accordingly, it is difficult or impractical to mix liquids with polymers during extrusion as the liquids are not viscous enough to form a film around the pellets prior to melting, or the liquids are too volatile and flash off in the compression section of the screw to escape through the extruder throat. Also, if added by themselves in small quantities, there is a problem of the additives not feeding uniformly.

Embodiments of the presently disclosed subject matter overcome limitations of the art by providing for a system and method for introducing liquid additives into polymers during the production of fibers, particularly those blends of polymers and liquids that are not suitable for compounding into a masterbatch. Embodiments of the presently disclosed subject matter provide for the use of poly-alpha-olefin (PAO) fluids as carriers for liquid additives as a way to stabilize the resulting mixture fluid and make the mixture more compatible for subsequent mixing with the polymer. According to various embodiments, the methods as disclosed herein include introducing liquid additive during the melt spinning of polymeric fibers by using a poly-alpha-olefin (PAO) fluid as carrier. In various embodiments, the liquid additive can include items such as fragrances, repellents, antimicrobial compounds, and similar other materials that are compatible with PAO and can be blended with PAO without the need for a compatibilizer. In one embodiment, the PAO can be of the amorphous type, i.e., the PAO can be an amorphous PAO (APAO). Embodiments of the presently disclosed subject matter further provide for the slow release of the additives from the polymeric fibers over an extended period of time while an article made from the additive infused polymeric fibers is being used by the end user. For example, the methods as disclosed herein can allow for the slow release of a fragrance-causing additive over an extended period of time from an article of clothing made of polymeric fibers while the article of clothing made from the material fabricated by methods as described herein is being used by a person. Embodiments disclosed herein advantageously provide for the mixing of one or more liquid additives with PAO prior to the blend being added to the polymer, with the blend being added to the polymer either before extrusion or during extrusion.

Melt spinning is a cost effective and the fastest fiber fabrication system on the market to date. In melt spinning, a polymer is melted in an extruder and heated to a suitable viscosity for fiber production, then pushed through a spinneret and promptly cooled. FIG. 1 illustrates a schematic of an extrusion process being performed with an extruder 100 used for the melt spinning process. As illustrated in FIG. 1, in a typical melt spinning process, a polymer melt 12 first passes through a metering pump 14 that controls the flow of polymer melt. The polymer melt 12 then flows through a filter 18 onto a spinneret 16. Streams of viscous polymer exit via the spinneret 16 into air quench 20 (or a liquid quench) leading to a phase inversion which allows the polymer to solidify into fibers 28. The fibers are then passed through convergence guide 22 before they pass through godets 24 to be spun onto spin bobbins 26. While only one fiber forming process may be described herein, various other fiber forming processes can also be used—examples include: meltblowing, spunbonding, force spinning and other fiber forming processes uses to form fibers, filaments or nonwoven fabrics.

Under currently prevailing methods, melt spinning is incapable of working with liquid additives, for example liquid additives that include items such as fragrances, repellents, antimicrobial compounds, and similar other materials. Until now, liquid additives could not be used directly in the extrusion process unless they were compatibilized or encapsulated in another material. By contrast, various embodiments of the presently disclosed subject matter use poly-alpha-olefin (PAO) fluid that acts as a carrier for liquid additives thereby making it possible to include liquid additives in the extrusion process. Poly-alpha-olefin (PAO) is compatible with many polymer systems that containing an olefin block. Thus, the liquid additive can be used in a variety of polymers. According to various embodiments of the presently disclosed subject matter, the liquid additive(s) can be mixed with poly-alpha-olefin (PAO) fluid prior to adding this blend to the polymer before or during the extrusion process. One or more liquid additives mixed with a PAO fluid can then be spun into a fiber article that allows for the slow release of the additives from the article during use by an end-user. Examples of the liquid additives can include items such as fragrances, repellents, antimicrobial compounds, and similar other materials that are compatible with PAO and can be blended with PAO without the need for a compatibilizer, where benefits are accruable by the slow release of such materials. Embodiments of the presently disclosed subject matter can thereby result in fibers that can have the ability to prolong the release of additives such as fragrances, repellents, antimicrobial compounds, and similar other materials from the fibers fabricated using the methods as described herein. In various embodiments, the liquid additive should be compatible with the PAO such that it blends with the PAO. In at least one embodiment, the polymer shall have an olefin block to be compatible with the PAO. It should be noted that polyesters and PAO do not work together.

Figure 3:
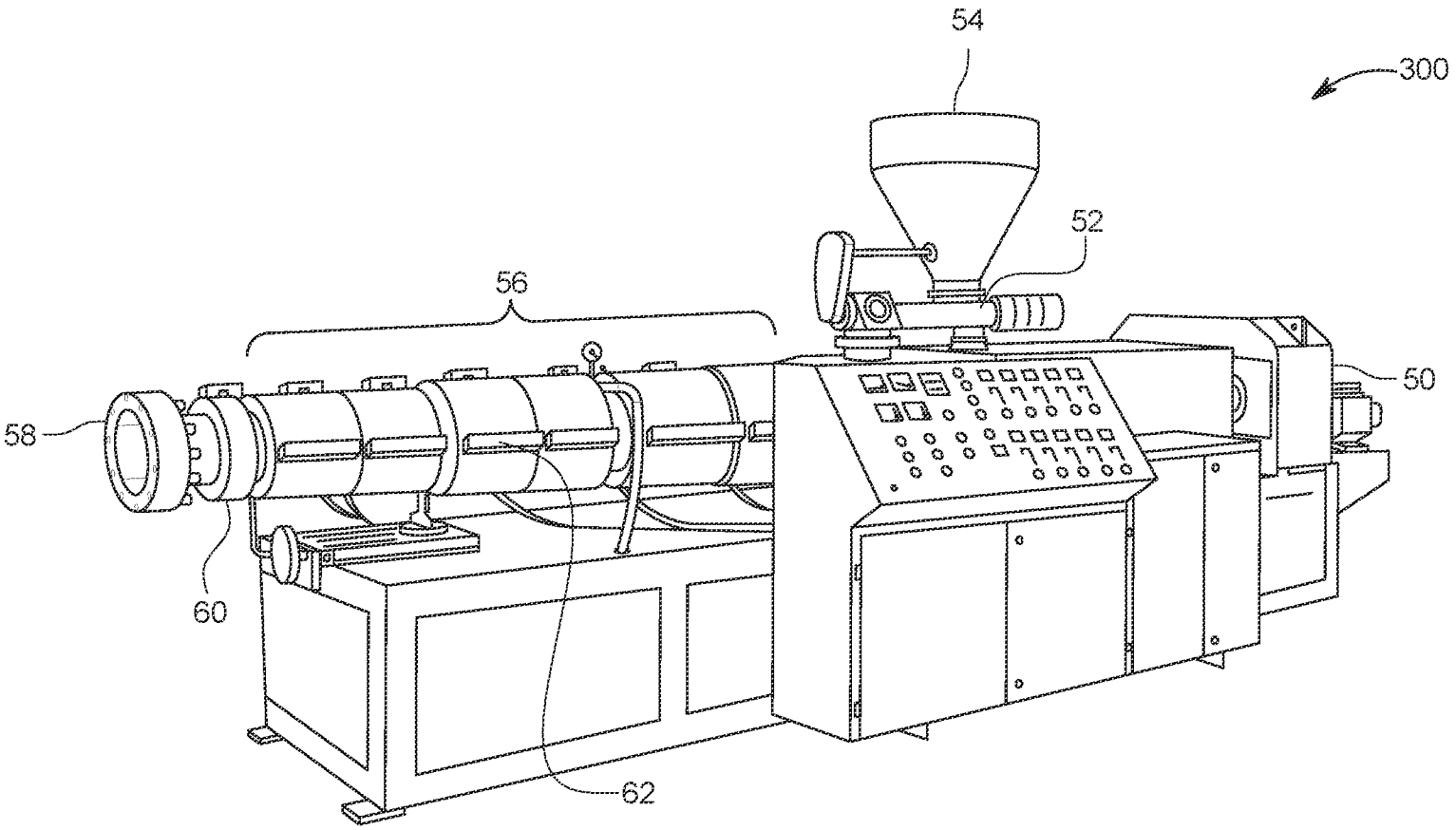
FIG. 3 illustrates a perspective view of an extruder used for a melt spinning process, according to one or more embodiments of the presently disclosed subject matter.

According to at least one method, a liquid additive is combined with a specifically selected poly-alpha-olefin (PAO) fluid to form a blend. This blend is injected into the extruder that processes the polymer to be spun into fibers. FIG. 3 illustrates an extruder 300. As illustrated in FIG. 3, extruder 300 includes a hopper 54 into which a material, for example, a polymer is fed in-either pellet or powder form. The polymer passes through feed throat 52 onto barrel 56 that houses a screw. The screw in barrel 56 is turned by drive unit 50, and a heating element 62 heats the polymer as it makes it way forward through barrel 56. The polymer then passes through a breaker plate 60, which is a perforated plate at the end of an extruder head. Breaker plate 60 operates to support a screen to keep foreign particles out of the die and to reduce screw beat. The polymer finally exits the extruder 300 through a die 58. Die 58 includes one or several openings where the polymer/material being processed exits through under pressure.

Figure 2:
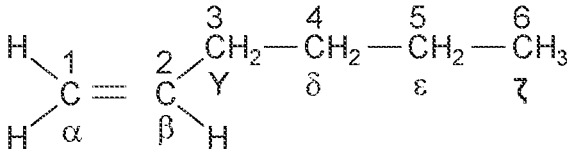
FIG. 2 illustrates the chemical structure of a poly-alpha-olefin (PAO) molecule, according to one or more embodiments of the presently disclosed subject matter.

FIG. 2 illustrates a poly-alpha-olefin (PAO) molecule. Poly-alpha-olefin (PAO) fluids are made of low molecular weight branched polymers and result from the polymerization of alpha olefin. A poly-alpha-olefin (PAO) fluid is non-polar and therefore is resistant to hydrolysis and oxidation. Poly-alpha-olefin (PAO) fluids are generally used as a main component of synthetic oils and lubricants. PAO fluids are presently used as lubricants and synthetic oils for motorized vehicles and have been used as an additive for polypropylene fibers to impart softness to the fibers; however, to date, PAOs have not been mixed with liquid additives and fed to an extruder with the intent of creating fibers that prolong the release of additives.

Using a PAO fluid as a carrier allows for good dispersion of the liquid additive into the polymer. The results are superior when the polymer is a polyolefin polymer since polyolefins have good compatibility with the PAOs. Examples of polymers containing polyolefins include polypropylene, polyethylene (such as low-density polyethylene, high-density polyethylene, and linear low-density polyethylene, for example), and polyolefin copolymers, elastomers containing a propylene or ethylene block among others. The methods as described herein can be used with polymers containing polyolefins; the methods described herein can also be used with other kinds of polymers as long as the PAO fluid can disperse well into them. For example, the PAO fluids are also compatible with additional classes of polymers such as styrene-ethylene-butylene-styrene (SEBS), thermoplastic polyurethanes (TPUs) and thermoplastic elastomer (TPEs), among others.

According to various embodiments of the presently disclosed subject matter, there are multiple ways for introducing the liquid additive and PAO blend to the extruder. In one example, the blend is precisely pumped into the throat of the extruder while the polymer is being fed into the extruder. In another example, the blend is pumped into a port that is drilled into the extruder barrel and the blend directly injected into the polymer through the port. In at least one embodiment, a blend of additive(s) and PAO is created, then a pump is used to meter precise amounts of the blend that is dripped into the throat of the extruder. According to at least one embodiment, the blend of liquids is pumped into a port drilled in the extruder barrel in order to inject it into the polymer. In one example, the port is drilled into the barrel in a position located right after the compression section of the extruder screw, this being a point where the great majority of the polymer is molten. In another example, the port is drilled in a position that is further away from the compression section as long as there is enough mixing action performed by the screw and gear pump to insure a good dispersion of the additive into the polymer.

In at least one embodiment, the polymer containing the additive and the PAO is or can be processed through a spinneret to form filaments or fibers. The filament may be a homo-filament or a multi-component filament. Examples of a multi-component filament or fiber include: a sheath and core (S/C) multi-component filament, a side-by-side (S/S) multi-component filament, and/or an island in sea (INS) multi-component filament. The use of multi-component filaments can be very beneficial for various reasons. For example, by having a S/C multi-component filament where the additive is added only to the core can help control and slow down the release of the additive. On the other hand, by including the additive only in the sheath of a S/C multi-component filament can help provide the benefit offered by the additive while simultaneously reducing the cost associated with the additive. The use of INS multi-component fiber wherein the micro-filaments are released by fracturing or dissolving of the sea component can offer a much greater surface to allow better transfer of the additive to other surface; for example, such a procedure can allow for better transfer of the additive to the skin of the person wearing a garment made of the INS multi-component fiber.

The fiber forming processes associated with the methods disclosed herein can comprise all commonly known fiber forming processes s where a polymer is meltspun. Examples include melt spinning of filaments to be used as is or to be converted into staple fibers, the production of spunbond, and the production of meltblown, among others.

According to various embodiments, the additives that can be dispersed into a polymer by the methods described herein comprise all varieties of additives that are soluble in PAOs or are dispersible into PAOs. Illustrative examples comprise essential oils extracted from plants, natural fragrances, synthetic fragrances, natural molecules and synthetic molecules, among others. In various embodiments, the purpose of the additive may include: (1) providing a fragrance that is to slowly release from the polymer forming the fibers; (2) slowly releasing an insect repellent or an antimicrobial compound; (3) delivering molecules that are beneficial to the human body and that can be absorbed through the skin; and (4) supplying a compound that is valued for its aromatherapy virtue, among others. These examples are only illustrative; accordingly, the list of additives and their applications are in no way limited. Additional applications of the presently disclosed subject matter can include fabric containing an insect repellent, a fabric that slowly releases molecules that are beneficial for the skin, a fabric that slowly release liquid based antimicrobial molecule, and all other applications of parallel or similar nature.

In one embodiment, the steps for adding any suitable liquid additive using the methods as disclosed herein includes incorporating the liquid additive into a thermoplastic polymer and achieving good enough dispersion to allow for the additives to release slowly from the fibers formed from the material.

As used herein, the term "fiber" includes fibers of extreme or indefinite length (filaments) and fibers of short length (staple). The term "yarn" refers to a continuous strand or bundle of fibers. The terms "multi-component fiber" refer to fibers having at least two distinct cross-sectional longitudinally coextensive domains respectively formed of different polymers. The distinct domains may thus be formed of polymers from different polymer classes (e.g., nylon and polypropylene) or be formed of polymers from the same polymer class (e.g., nylon) but which differ in some aspect examples being their respective relative viscosities, structure (e.g., difference in molecular weight distribution) or their formulation (e.g., presence of additive). The term "multi-component fiber" is thus intended to include concentric and eccentric sheath-core fiber structures, symmetric and asymmetric side-by-side fiber structures, island-in-sea fiber structures and pie wedge fiber structures.

Multi-component fibers can further include fibers that combine at least two polymers having properties and/or different chemical compositions. The polymers are extruded together, and its relative position along the fiber length depends on factors like the geometry of orifices of the spinneret and the intrinsic properties of the polymer itself, including viscosity and molecular weight. Distinct domains of the multi-component fibers as mentioned herein can be formed of an amorphous linear polymer which in and of itself may be non-fiber-forming. Suitable amorphous polymers for use in the practice of this invention can include polystyrene, polyisobutene and poly(methyl methacrylate). Each distinct domain forming the multi-component fibers as mentioned herein may be formed from different polymeric materials Alternatively, some of the domains may be formed from the same polymeric materials which differ in terms, e.g., of their relative viscosities, additive content, and the like. According to various embodiments, the multi-component fibers can be spun using conventional fiber-forming equipment.

As described herein, a method of producing fibers comprises forming a blend of a liquid additive and a poly-alpha-olefin (PAO) fluid; melting a polymer within an extruder; adding the blend to the melted polymer to form a composition; and spinning fiber from the composition. The blend can be added to the polymer before it has been melted into the extruder; the blend can also be added to the polymer as the polymer is being melted in the extruder.

According to one embodiment, a method of producing fibers comprises forming a blend of a liquid additive and a poly-alpha-olefin (PAO) fluid; adding the blend to a polymer to form a composition; melting the polymer in the composition within an extruder; and spinning fiber from the composition. According to one embodiment, method of producing fibers comprises: forming a blend of a liquid additive and a poly-alpha-olefin (PAO) fluid; melting a polymer within an extruder; adding the blend to the melted polymer to form a composition; and spinning fiber from the composition.

According to one embodiment, a method of producing fibers comprises forming a blend of a liquid additive and a poly-alpha-olefin (PAO) fluid; providing a polymer; adding the blend to the polymer followed by melting the polymer in an extruder to form a molten composition, or melting the polymer in the extruder followed by adding the blend to the melted polymer to form a molten composition; and spinning fibers from the molten composition.

In at least one embodiment, the spun fiber is a continuous filament fiber or a staple fiber. In some embodiments, the spun fiber is a nonwoven web. In at least one embodiment, the spun fiber and/or the nonwoven web can be a spunbond nonwoven fiber/web, a hydro-entangled nonwoven fiber/web, and/or a meltblown nonwoven fiber/web. In at least one embodiment, the nonwoven webs a composite; accordingly, in various embodiments, the nonwoven web can be a composite comprising a spunbond nonwoven web, a hydro-entangled nonwoven web, and/or a meltblown nonwoven web.

In various embodiments, the fiber can be a mono-component fiber, a bi-component fiber, and/or a multi-component fiber. In various embodiments, the fiber can be a multi-component fiber. The multi-component fiber, in turn, can have one or more of the following cross-sections: sheath and core (S/C), side-by-side (S/S), segmented pie, segmented ribbon, tipped trilobal, and island in sea (INS).

In various embodiments, the method can further include the forming of a multi-component fiber that consists of a domain and other components. In this multi-component fiber, the liquid additive can be added just to the domain, but not to the other components of the multi-component fiber.

In at least one embodiment, the method can further include the forming of a multi-component fiber that consists of a plurality of domains and other components. In this multi-component fiber, the liquid additive can be added just to the domains that are exposed at an outer surface of the component fiber, but not to the other components of the multi-component fiber.

In some embodiments, the spun fiber is a meltspun fiber. In some embodiments, the meltspun fiber is a multi-component fiber comprising a domain and other components, wherein remnants of the liquid additive are more concentrated in the domain as compared to the other components of the multi-component fiber. In some embodiments, the meltspun fiber includes a multi-component fiber consisting of a plurality of domains and other components, wherein remnants of the liquid additive are more concentrated in the domains exposed at an outer surface of the multi-component fiber as compared to the other components.

In some embodiments, the method comprises forming a multi-component fiber consisting of a plurality of domains and other components, wherein the liquid additive is added to domains exposed at an outer surface of the component fiber, wherein the liquid additive is not added to the other components.

In some embodiments, the fiber formed is a nonwoven meltspun fiber. In some embodiments, the nonwoven meltspun fiber and be a multi-component fiber comprising a domain and other components; in such a multi-component fiber, portions of the liquid additive can be more concentrated in the domain as compared to the other components of the multi-component fiber. In some other embodiments, the nonwoven meltspun fiber can be a multi-component fiber including a plurality of domains and other components; in such a multi-component fiber, portions of the liquid additive can be more concentrated in the domains exposed at an outer surface of the multi-component fiber as compared to the other components of the multi-component fiber.

In some embodiments, the fiber is a nonwoven meltspun fiber. In such embodiments, the nonwoven meltspun fiber can be a multi-component fiber that includes a domain and other components; in such a multi-component fiber, portions of the liquid additive can be more concentrated in the domain as compared to the other components; in the same embodiment or in a different embodiment, the nonwoven meltspun fiber can be a spunbond nonwoven meltspun fiber, a hydro-entangled nonwoven meltspun fiber, and/or a meltblown nonwoven meltspun fiber. In some embodiments, the nonwoven meltspun fiber can be a multi-component fiber that includes a plurality of domains and other components; in such an embodiment, portions of the liquid additive can be more concentrated in the domains exposed at an outer surface of the multi-component fiber as compared to the other components; in the same embodiment or in a different embodiment, the nonwoven meltspun fiber can be a spunbond nonwoven meltspun fiber, a hydro-entangled nonwoven meltspun fiber, and/or a meltblown nonwoven meltspun fiber.

In some embodiments, the fiber formed is a nonwoven meltspun fiber that comprises a spunbond nonwoven meltspun fiber, a hydro-entangled nonwoven meltspun fiber, and/or a meltblown nonwoven meltspun fiber.

According to at least one embodiment, a method of fabricating a fiber includes: forming blends of liquid additive and poly-alpha-olefin fluid; adding such blend to the polymer prior to or after it has been melted into the extruder; and, spinning fiber from this composition. According to at least one embodiment, the method further comprises the production of spunbond nonwoven, a hydro-entangled nonwoven or a meltblown nonwoven or composites that include any of those three types of nonwovens.

In some embodiments, the fibers produced can be monocomponent, bi-component or multi-component fibers. In some embodiments, the multi-component fibers comprise cross section that are of the sheath/core, side-by-side, segmented pie, segmented ribbon, tipped trilobal, or island by the sea types.

In one embodiment, the fiber is a multi-component fiber wherein at least one liquid additive is added only to the domain or domains surrounded by at least one domain where none of the additive is added in their melt formulation. In on embodiment, the fiber is a multi-component fiber wherein the additive is added to the formulation that formed the domain or domains that are exposed at the outside of the fiber. In one embodiment the fiber is a multi-component fiber wherein the additive is substantially more concentrated in the polymer domain or domains surrounded by another polymer domain In on embodiment, the fiber is a meltspun fiber that includes at least a liquid additive, a poly-alpha-olefin carrier and a polymer. In on embodiment, the fiber is a meltspun multi-component fiber wherein the additive is substantially more concentrated in the polymer domain or domains located on the outside of the fiber.

A first illustrative example of practicing the various embodiments of the presently disclosed subject matter follows. According to the example, polypropylene filaments were produced on a LBS 300 filament production line manufactured by Hills Inc. The line was operated in monocomponent mode with a single extruder feeding polypropylene polymer to a pump that metered it to a spinneret having 72 capillaries. The polymer was processed through the capillaries at an about rate of 0.55 g per capillary per minute, formed filaments that were drawn and air quenched. The filaments were subsequently drawn further at a draw ratio of 2:1 using a typical system of godet rolls. The yarn formed from those filaments was wound onto a cardboard core and collected.

Four fluid blends were previously prepared by mixing different fragrances into a PAO fluid commonly available in the market. The fragrances used were from Orchidia, Downers Grove, IL USA. Each fluid blend comprised about 20% of the fragrance solution and looked very homogeneous, a sign that the fragrances were compatible with the PAO. For the examples described, Blend 1 was an 80:20 blend of the PAO and a fragrance named Fabric Softener Concentrate. Blend 2 was an 80:20 blend of the PAO and a fragrance named Fabric Softener Top Notes. Blend 3 was an 80:20 blend of the PAO and a fragrance named Fabric Softener Bottom Notes. Blend 4 was an 80:20 blend of the PAO and a fragrance named Cedar Citronella. All of those blends were verified visually to ensure that the ingredients were compatible and forming homogenous solutions.

Each of the fluid blends were used to spun filament samples. For the production of all of the filament samples comprising one of the solution blend, the selected fluid blend was dripped into the polymer pellets through the throat of the extruder, wherein the throat was filled with polymer pellets being fed to the extruder. In addition to the samples made from the above mentioned blends, two filaments samples were made with no solution added to the polymer and, one additional sample was made with addition of 3% by weight of the PAO.

The results indicated that the packages made by the above described process and comprising one of the fragrance/PAO blend were found to have a strong smell of the fragrance even after several weeks of storage at room temperature. The filaments produced by the above-described process were tested for size and other physical properties, and an important observation made was that the addition of oil had zero to minimal impact on the physical properties of the filaments formed by the above-described process.

Figure 4B:
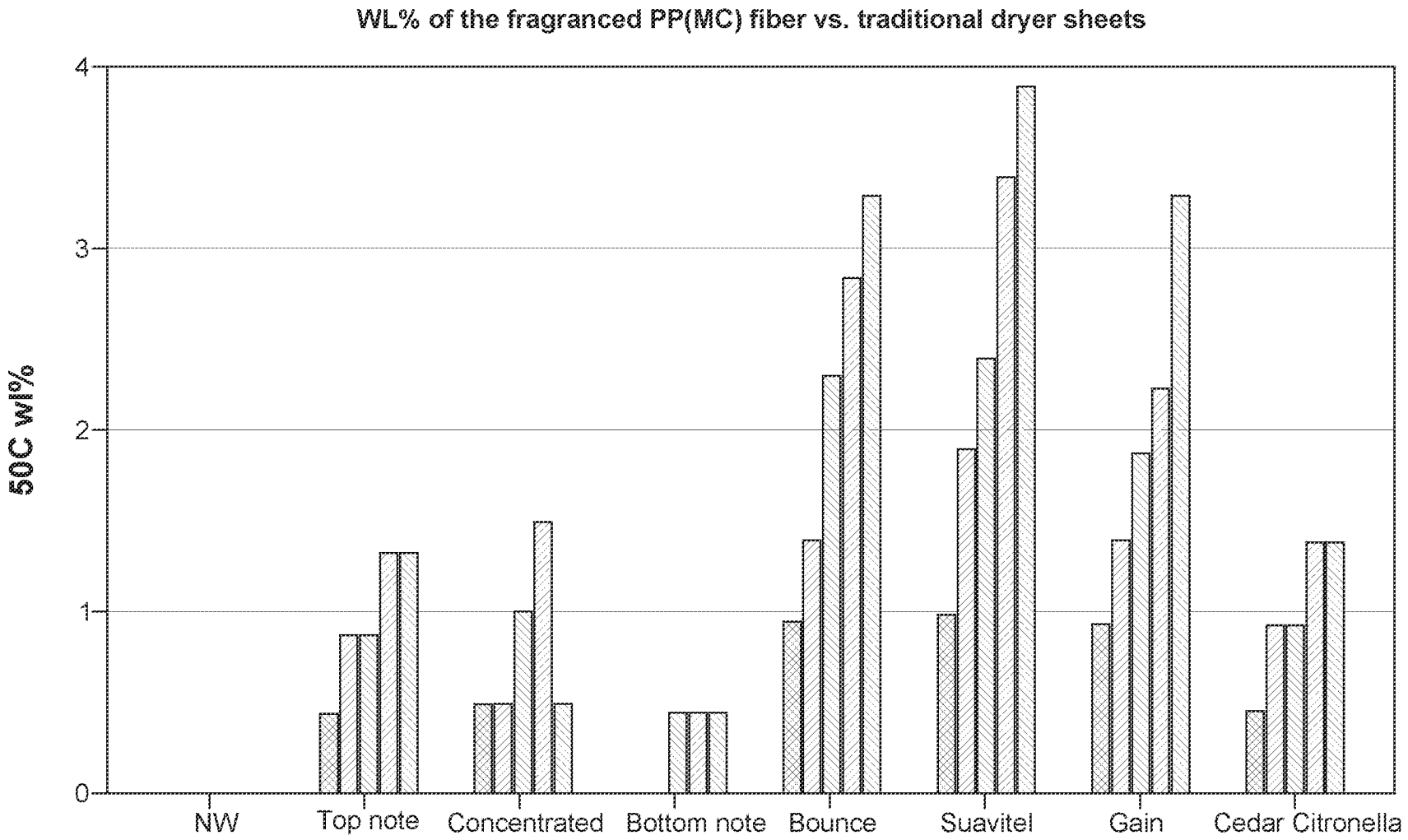
FIG. 4B illustrates results from a weight loss percentage (WL %) test conducted on fibers fabricated using the methods described herein as compared to traditional dryer sheets, according to one or more embodiments of the presently disclosed subject matter.

FIGS. 5-8 summarize the results of the testing of physical properties of 22 samples of the filaments formed by the above-described process. FIGS. 4A and 4B illustrate results from a weight loss percentage (WL %) test conducted on fibers fabricated using the methods as described herein as compared to traditional dryer sheets. In mono-component polypropylene (PP) fiber materials, the weight loss test was conducted at 50 degree Celsius under UV light on the following samples: knitted sock made with PP homopolymer filaments baseline sample comprising no liquid additive and identified in the Table illustrated in FIG. 5 as Sample 1, knitted sock made with PP filaments comprising 3% of Blend 2 (Fabric Conditioner Top Note fragrance) identified as Sample 6 in the Table illustrated in FIG. 5, knitted sock made from PP filaments comprising Blend 1 (Fabric Conditioner Concentrate fragrance), knitted sock made from PP filaments comprising Blend 3 (Fabric Conditioner Base Note fragrance) identified as Sample 7 in the Table illustrated in FIG. 5; Gain® dryer sheet; Suavitel® dryer sheet; Bounce® dryer sheet; and knitted sock made from PP filaments comprising Blend 4 (Cedar-Citronella fragrance).

It was observed that the weight loss percentage (WL %) in the knitted fibers was lower than the WL % in the traditional dryer sheets. With regard to the appearance, the PP control samples without fragrance were tested for discoloration in oven and all control samples passed the tests. It was noticed that the PP knitted fibers did not discolor under the UV light and 50 degree Celsius during the 30-day test period; by contrast, the traditional dryer sheets turned into a yellowish shade. The olfactory tests conducted on the knitted scented PP fibers in clean rooms at 22 degrees Celsius showed that the knitted scented PP fibers had an average strength odor after 6 weeks of stability. None of the fiber samples and dryer sheets smelled any of their initial odors after the 12 days of testing in oven at 50 degrees Celsius; however, this result was as expected.

The observations and conclusions of this first set of experiments are: (1) it is possible to extrude the mixture into a fiber; (2) the fibers comprising the fragrance/PAO oil blend exhibit strong aroma; (3) processing on small extruder was limited only in terms of feeding and not spinning; therefore, producing spunbond from such mixture should pose little or no problem; (4) little or no fumes were observed; and (5) 3% oil and fragrance blend add-on had no to little impact on filament tensile properties.

In a second illustrative example sheath/core bicomponent filaments were produced using both extruders from the LBS fiber spinning line. The polymers fed from those extruders were combined into a spinneret where one of the polymers was directed to form the core of the filaments and, the other polymer was directed to form the sheath of the filaments. In this illustrative example polypropylene was used to form the sheath and the core. The weight ratio of the sheath and core was 30:70. Again, the filaments were drawn at a 2:1 ratio and the process parameter were set to produce 3 denier filaments. For this example the Blend 1 or Blend 4 described above was added by dripping it only to the throat of the extruder that provided the polymer for the core. A sample was made by adding Blend 1 at a loading that is equal to about 4% of the core polymer weight (or about 2.8% of the total filament weight). Additional samples were made by respectively adding 6 and 8% of Blend 1 to the core of the filaments (or about 4.2 and 5.6% of the total filament weight). An additional sample was made by adding 4% of the Blend 4 to the core of the filaments (or 2.8% of the total filament weight). The purpose of adding the Blends to the core was to make samples where, in theory, less of the fragrance would flash out of the filament while still molten and, where a slower rate of release was to be expected while in use. For comparison purpose, the inventors also fabricated baseline filament sample with no fragrance/oil mixture added to the filaments.

In a third illustrative example, sheath/core bicomponent filaments were produced in a similar manner as in the second illustrative example with the exception that the sheath/core ratio had a 50:50 ratio, and Blend 1 or Blend 4 was added by dripping it only to the throat of the extruder that fed the polymer used to form the sheath. A first sample was made by adding Blend 1 at a loading that is equal to about 5.6% of the sheath polymer weight. A second sample was made by adding 5.6% of the Blend 4 to the sheath of the filaments. For comparison purpose, the inventors also fabricated baseline filament samples with no fragrance/oil mixture added to the filaments.

In a fourth illustrative example, using the same configuration as the second illustrative sample, 30:70 sheath/core bicomponent filaments were produced with polyethylene forming the sheath and polypropylene forming the core. For this example the Blend 1 or Blend 4 was added only to the extruder that feeds the polymer used to form the core. A first sample was made by adding Blend 1 at a loading that is equal to about 4% of the core polymer weight (or about 2.8% of the total filament). A further sample was made by adding 6% of Blend 1 to the core of the filaments (or about 4.2% of the total filament weight). A furthermore sample was made by adding 4% of the Blend 4 to the core of the filaments (or 2.8% of the total filament weight). For comparison purposes, the inventors also fabricated baseline filament sample with no fragrance/oil mixture added to the filaments.

Olfactory tests were conducted in bi-component polypropylene (PP) fiber materials, and after several odor trials in the clean rooms, the following strongest smelling version was used for the test: PE/PP 30:70 S/C with Blend 1 at 6% in the core.

The inventors, through their experimental work, have determined that volatile solutions such as fragrances when added to a PAO oil could be processed (by extrusion) with polyolefin, and more precisely with polypropylene. They have also determined that by using this approach, the blend of PAO and fragrance could be processed into homofilaments made of polypropylene. This was demonstrated at loading of up to 4% loading by weight of the PAO/fragrance solution. Through their experimental work, the inventors have further determined that adding the fragrance/oil mixture to the sheath or the core of a sheath/core bicomponent fiber is feasible. Addition of the mixtures at 4 or 6% to the core was successfully demonstrated with PP/PP or PE/PP S/C filaments. It was further observed that the spinning process was found to less stable at 8% add-on level. This limitation might be specific to the equipment used for the testing, reflecting the mixing ability for this extruder screw design.

In view of the fumes/smoke observed when adding the fragrance/oil mixture to the sheath, opportunities exist for adding the fragrance/oil mixture to the core if a high loading is desired. The inventors have further observed that excessive fumes can form deposits on the spinneret face and other internal surfaces of the spinning chamber and, at long term those can impact the process stability.

The experiments have demonstrated the concept of adding fragrance dispersed into oil to homo filaments or bicomponent filaments. The process can be scaled up to the spunbond line and use to produce nonwoven fabrics. The results allow for further exploring addition of the fragrance/oil mixture to the core of sheath/core filaments. This approach can minimize the generation of fumes during spinning and it further has the potential to extend the life of the product by using the nature of the sheath to control the release rate of the fragrance (e.g., nature of the polymer used for the sheath, and thickness of the sheath, among others). Also, selection of the polymer for the sheath can open the door to applications where filaments made only of polyolefin could not be a good fit. For example, there is a potential of PET/PP or PA6/PP S/C filaments being used for higher temperature applications.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A method of producing fibers comprising:

forming a blend of a liquid additive and a liquid additive carrier, wherein the liquid additive carrier includes a poly-alpha-olefin (PAO) fluid, wherein the liquid additive includes a fragrance, wherein the fragrance is soluble or dispersible in the PAO fluid;

providing a polyolefin polymer in a pelletized form, wherein the polyolefin polymer includes polypropylene;

adding, through a port drilled into an extruder barrel of an extruder, the blend to the pelletized polyolefin polymer followed by melting the pelletized polyolefin polymer in the extruder to form a molten composition, or melting the pelletized polyolefin polymer in the extruder followed by adding the blend to the melted pelletized polymer to form a molten composition;

spinning fibers from the molten composition; and fabricating one or more fibers from the molten composition, wherein the one or more fibers includes a slow-release fiber, wherein the slow-release fiber releases the liquid additive.

2. The method of claim 1, further comprising fabricating one or more of a continuous filament fiber and a staple fiber from the molten composition.

3. The method of claim 1, further comprising fabricating a nonwoven web from the molten composition, wherein the nonwoven web comprises one or more of: a spunbond nonwoven web, a hydro-entangled nonwoven web, and a meltblown nonwoven web.

4. The method of claim 1, further comprising fabricating a nonwoven web from the molten composition, wherein the nonwoven web is a composite comprising one or more of: a spunbond nonwoven web, a hydro-entangled nonwoven web, a meltblown nonwoven web.

5. The method of claim 1, wherein the one or more fibers further comprises a multi-component fiber, wherein the multi-component fiber comprises one of a: sheath and core (S/C) cross-section, side-by-side (S/S) cross-section, segmented pie cross-section, segmented ribbon cross-section, tipped trilobal cross-section, and island in sea (INS) cross-section.

6. The method of claim 1, wherein the method further comprises forming a multi-component fiber comprising a domain and a plurality of components, wherein the liquid additive is added to the domain, wherein the liquid additive is not added to the plurality of components.

7. The method of claim 1, wherein the method further comprises forming a multi-component fiber comprising a plurality of domains and a plurality of components, wherein the liquid additive is added to domains exposed at an outer surface of the multi-component fiber, wherein the liquid additive is not added to the plurality of components.

8. The method of claim 1, wherein the method further comprises forming a meltspun fiber, wherein the meltspun fiber comprises a multi-component fiber comprising a domain and a plurality of components, wherein a concentration of the liquid additive is higher in the domain as compared to the concentration of the liquid additive in each of the plurality of components.

9. The method of claim 1, wherein the method further comprises forming a meltspun fiber, wherein the meltspun fiber comprises a multi-component fiber comprising a plurality of domains and a plurality of components, wherein a concentration of the liquid additive is higher in the domains exposed at an outer surface of the multi-component fiber as compared to the concentration of the liquid additive in each of the plurality of components.

10. The method of claim 1, wherein the one or more fibers further comprises a nonwoven meltspun fiber, wherein the nonwoven meltspun fiber comprises a multi-component fiber comprising a domain and a plurality of components, a concentration of the liquid additive is higher in the domain as compared to the concentration of the liquid additive in each of the plurality of components.

11. The method of claim 1, wherein the one or more fibers further comprises a nonwoven meltspun fiber, wherein the nonwoven meltspun fiber comprises a multi-component fiber comprising a plurality of domains and a plurality of components, wherein a concentration of the liquid additive is higher in domains exposed at an outer surface of the multi-component fiber as compared to a remainder of the plurality of domains and as compared to the each of the plurality of components.

12. The method of claim 1, wherein the one or more fibers further comprises a nonwoven meltspun fiber, wherein the nonwoven meltspun fiber comprises one or more of: a spunbond nonwoven meltspun fiber, a hydro-entangled nonwoven meltspun fiber, and a meltblown nonwoven meltspun fiber.

13. The method of claim 11, wherein the nonwoven meltspun fiber comprises a multi-component fiber comprising a plurality of domains and a plurality of components, wherein a concentration of the liquid additive is higher in domains exposed at an outer surface of the multi-component fiber as compared to a remainder of the plurality of domains and as compared to the each of the plurality of components, wherein the nonwoven meltspun fiber comprises one or more of: a spunbond nonwoven meltspun fiber, a hydro-entangled nonwoven meltspun fiber, and a meltblown nonwoven meltspun fiber.

14. The method of claim 1, wherein at least one fiber of the one or more fibers comprises a multi-component fiber, wherein the multi-component fiber includes a sheath and a core, wherein a weight ratio of sheath is 30 percent of the multi-component fiber, wherein the core is 70 percent of the multi-component fiber, wherein the sheath includes polyethylene, wherein the core includes polypropylene, wherein the multi-component fiber is a slow-release fiber designed to slowly release the liquid additive.

15. The method of claim 1, wherein at least one fiber of the one or more fibers comprises a multi-component fiber, wherein the multi-component fiber includes a sheath and a core, wherein the liquid additive is added to the sheath or the core, wherein the sheath includes polyethylene, wherein the core includes polypropylene, wherein the multi-component fiber is a slow-release fiber designed to slowly release the fragrance.

16. The method of claim 1, wherein the PAO fluid is PAO oil.

17. The method of claim 1, wherein a weight ratio of the blend of the fragrance and the PAO fluid is 20:80.

18. A method of producing fibers comprising:

forming a blend of a liquid additive and a liquid additive carrier, wherein the liquid additive carrier includes poly-alpha-olefin (PAO) oil, wherein the liquid additive includes a fragrance, wherein the fragrance is soluble or dispersible in the PAO oil;

providing a polyolefin polymer in a pelletized form, wherein the polyolefin polymer includes polypropylene;

adding, through a port drilled into an extruder barrel of an extruder, the blend to the pelletized polyolefin polymer followed by melting the pelletized polyolefin polymer in the extruder to form a molten composition, or melting the pelletized polyolefin polymer in the extruder followed by adding the blend to the melted pelletized polymer to form a molten composition;

pushing the molten composition through a spinneret to form a plurality of filaments, wherein at least one filament of the plurality of filaments is directed to form a core of at least one fiber, wherein at least one other filament of the plurality of filaments is direct to form a sheath of the at least one fiber; and spinning the plurality of filaments to fabricate the at least one fiber, wherein the at least one fiber comprises a multi-component fiber, wherein the sheath of the multi-component fiber is about 30% of a weight of the multi-component fiber, wherein the core of the multi-component fiber is about 70% of the weight of the multi-component fiber, wherein the sheath includes polypropylene, wherein the core includes polypropylene, wherein the multi-component fiber is a slow-release fiber designed to slowly release the fragrance.

19. The method of claim 18, wherein a weight ratio of the blend of the fragrance and the PAO oil is 20:80.

20. The method of claim 18, wherein the sheath of the at least one fiber includes the liquid additive.

* * * * *